US006019237A

United States Patent [19]

Durham et al.

[11] Patent Number: 6,019,237

[45] Date of Patent: Feb. 1, 2000

[54] MODIFIED CONTAINER USING INNER BAG

[75] Inventors: Michael D. Durham, Ventura; Stewart G. Cramer, Northridge; Terence Hall, Santa Monica, all of Calif.

[73] Assignee: Northrop Grumman Corporation, Los Angeles, Calif.

[21] Appl. No.: 09/055,604

[22] Filed: Apr. 6, 1998

[51] Int. Cl.[7] ..... B65D 25/14; B65D 88/54; B65D 90/32

[52] U.S. Cl. ..... 220/1.6; 109/49.5; 220/62.19; 220/88.1

[58] Field of Search ..... 220/1.5, 88.1, 220/560.06, 560.08, 560.15, 592.25, 592.23, 900, 905, 1.6, 609, 624, 62.19; 109/15, 1 R, 49.5; 86/50; 89/36.02, 36.04; 222/134

[56] References Cited

U.S. PATENT DOCUMENTS

| | | | |
|---|---|---|---|
| 374,845 | 12/1887 | Moss | 383/34 X |
| 398,530 | 2/1889 | Moore | 383/3 X |
| 1,351,388 | 8/1920 | Kabaci | 383/74 X |
| 2,312,637 | 3/1943 | Fulenwider et al. | 220/624 |
| 2,421,613 | 6/1947 | Gray et al. | 220/900 X |
| 2,971,671 | 2/1961 | Shakman | 220/624 |
| 2,973,119 | 2/1961 | Parker | 229/125.14 X |
| 3,173,573 | 3/1965 | Donegan | 220/495.02 |
| 3,298,577 | 1/1967 | Chlystun | 220/707 X |
| 3,648,613 | 3/1972 | Cunn | 109/49.5 X |
| 4,055,247 | 10/1977 | Benedick et al. . | |
| 4,366,917 | 1/1983 | Kotcharian | 220/560.08 X |
| 4,432,285 | 2/1984 | Boyars et al. . | |
| 4,795,047 | 1/1989 | Dunwoodie . | |
| 5,195,701 | 3/1993 | Willan . | |
| 5,267,665 | 12/1993 | Sanai et al. . | |
| 5,360,129 | 11/1994 | Lee | 220/1.5 |
| 5,390,580 | 2/1995 | Gibbons, Jr. et al. . | |
| 5,595,431 | 1/1997 | Mlakar . | |
| 5,599,082 | 2/1997 | Mlakar et al. . | |
| 5,645,184 | 7/1997 | Rowse et al. | 220/88.1 X |
| 5,819,972 | 10/1998 | Puente Pubill | 220/707 X |

*Primary Examiner*—Allan N. Shoap
*Assistant Examiner*—Joe Merek
*Attorney, Agent, or Firm*—Terry J. Anderson; Karl J. Hoch, Jr.

[57] ABSTRACT

In accordance with the present invention, in an aircraft storage container which is used for the transport of cargo items, defines an enclosed interior compartment and includes a hatch for selectively accessing the interior compartment, there is provided an improvement of the aircraft storage container. The improvement is provided with a high strength flexible bag member disposed about a substantial portion of the interior compartment for distributing force in response to explosive forces emanating from cargo items within the bag member. The bag member includes an opening and is positionable within the interior compartment such that the opening is adjacent the hatch for allowing cargo items to be placed into and removed from within the bag member via the hatch and the opening. The improvement is further provided with a bag opening frame which is attachable to the opening of the bag member and formed to receive cargo items for storage within the bag member therethrough. The bag member includes multiple overlapping door frame folds which are disposed adjacent the bag opening frame for distributing force away from the bag opening frame in response to explosive forces emanating from cargo items within the bag member.

17 Claims, 4 Drawing Sheets

Fig. 4
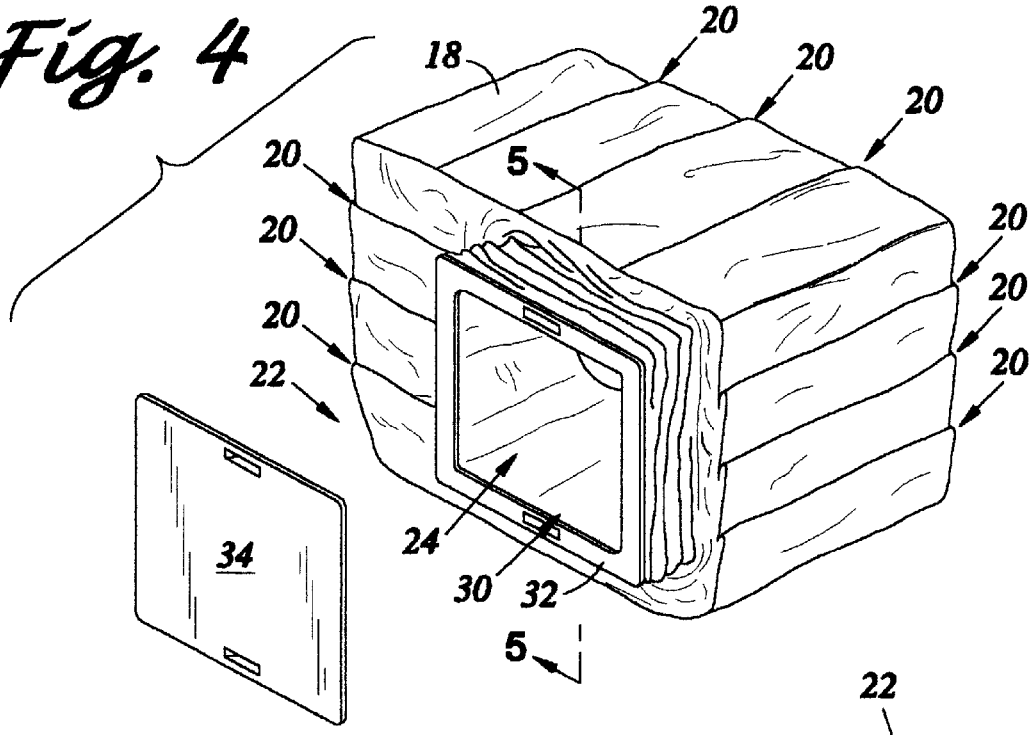
Fig. 5
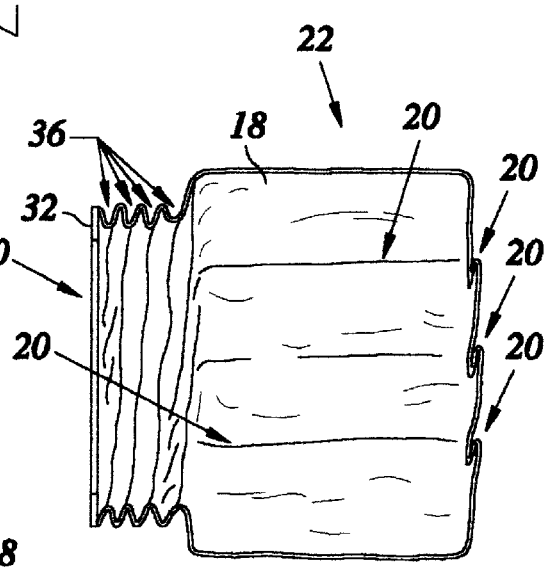
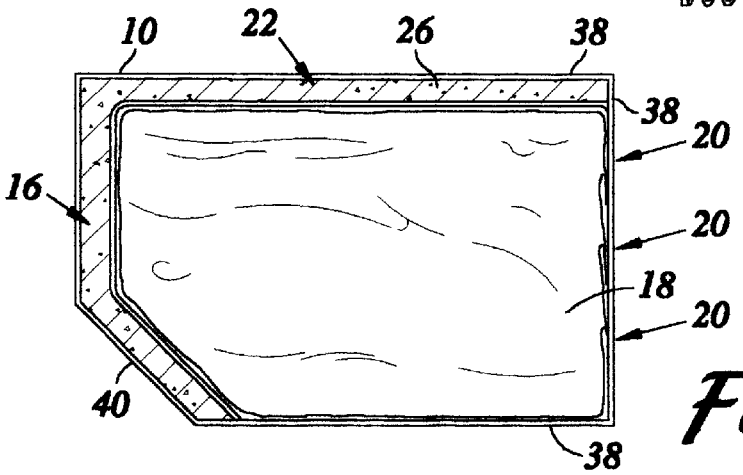
Fig. 6

MODIFIED CONTAINER USING INNER BAG

FIELD OF THE INVENTION

The present invention relates generally to aircraft storage containers, and more particularly to a storage container adapted to mitigate explosive forces occurring there within through the inclusion of an inner bag formed from a flexible high strength material.

BACKGROUND OF THE INVENTION

In the airline industry, it is a standard practice to compartmentalize the cargo which is be carried on board the larger aircraft. This is accomplished by separating the cargo into separate units and placing these units of cargo into individual containers which are commonly referred to as unit load devices (ULDs). Because of regulatory requirements, as well as practical considerations, the shape, size and weight of a ULD for each type of aircraft is standardized. Consequently, in order to design a ULD which will meet the standard requirements of the industry, and still effectively withstand the effects of a substantially large explosion emanating cargo held within the ULD, these limitations need to be considered.

Typically, ULD's are formed to include appropriately sloped surfaces that conform to the aircraft's fuselage when the ULD is placed in the aircraft's cargo compartment. Essentially, the ULD is formed from several panels which are joined together. Additionally, each ULD has an access hatch which allows for the placement cargo into and out of the ULD.

As a result of an explosion, a shock wave is produced which radiates outwardly in all directions from the explosion site. The shock wave is characterized by the formation of a relatively high pressure with a relatively short amount of time. When the shock wave encounters the interior portion of the ULD, the walls of the ULD experience stress. The flat portions of the walls are relatively strong and resist rupture. On the other hand, the highest stress concentrations which result from an explosion within the ULD tend to occur at the joints and around the door or hatch which covers the opening into the ULD. As a result of an explosion, these regions of localized high stress are usually the first to rupture or fail. An efficient structural design of the ULD would be such that no particular localized region would be especially susceptible rupture or failure as a result of an internal explosion. An obvious means for achieving this would be to selectively strengthen or reinforce the localized regions where the highest stress concentrations occur by simply adding material at those regions. Such reinforcement material, however, is undesirable due to the substantial increase in weight.

Accordingly, there is a need in the art for a device or method which mitigates the effects of explosive forces occurring within a storage container or ULD, thereby containing the explosion and mitigating damage to the aircraft. It is desirable that the device is relatively light weight and relatively easy to manufacture and may be used to modify existing stores of storage containers and ULDs.

SUMMARY OF THE INVENTION

In accordance with the present invention, in an aircraft storage container which is used for the transport of cargo items, defines an enclosed interior compartment and includes a hatch for selectively accessing the interior compartment, there is provided an improvement of the aircraft storage container. The improvement is provided with a high strength flexible bag member disposed about a substantial portion of the interior compartment for distributing force in response to explosive forces emanating from cargo items within the bag member. The bag member includes an interior, an exterior and an opening. The bag member is positionable within the interior compartment such that the opening is adjacent the hatch for allowing cargo items to be placed into and removed from within the bag member via the hatch and the opening. The improvement is further provided with a bag opening frame which is attachable to the opening of the bag member and formed to receive cargo items for storage within the bag member therethrough. The bag member includes multiple overlapping door frame folds which are disposed adjacent the bag opening frame for distributing force away from the bag opening frame in response to explosive forces emanating from cargo items within the bag member.

The bag member is constructed of a material demonstrating a relatively high tensile strength. The material of the bag member mitigates the explosive forces occurring there within. When explosive forces encounter the interior of the bag member, the bag member tends to locally deform to expand in a rounded manner. The high strength bag member strains against the explosive forces and in doing so the bag member acts to dampen and contain the explosive forces.

Importantly, the bag member includes the multiple overlapping door frame folds. Preferably, the door frame folds are formed by rotating the bag opening frame relative to the hatch such that the door frame folds have a spiral configuration about the bag opening frame. In practice, the storage container is provided with a hatch or door frame within the storage container, and sealably engages a relatively high strength door which covers the opening into the storage container or ULD via the bag opening frame interposed therebetween. In the absence of the present improvement, in response to an explosion within the storage container, the regions around the door and hatch/door frame typically experience relatively high stress concentrations. As such these localized regions are especially susceptible to rupture or failure. The inclusion of the multiple overlapping door frame folds act to distribute force away from these regions thereby mitigating resultant stress concentrations otherwise experienced in the absence of the present invention. With the present invention, however, in response to an explosion within the storage container, the bag member tends to outwardly expand within the storage container, and in doing so the explosive forces are translated to the bag member. In the absence of the folds, the forces within the expanding, straining bag member would directly encounter the attachment point between the bag opening frame and the rest of the bag member. Such a direct communication may result in a high stress concentration between the rigid bag opening frame and the flexible bag member. With the inclusion of the multiple overlapping folds adjacent the bag opening frame, the folds tend to capture and direct the expanding explosive forces away from the attachment point between the bag opening frame and the bag member. As such, the explosive forces are directed to the various other portions the bag member. Thus, due to the flexible nature of the material forming the bag member, the bag member directs and distributes force. In this regard, the bag member mitigates the development of localized stresses occurring at adjacent portions of the storage container.

The bag member may be formed from a formed from a polymer material as well as an elastomeric material and formed into flexible sheet of fabric. The bag member may be constructed from a fire resistant or retardant material and may be further coated with a fire resistant or retardant material.

The improvement further includes disposing a foam material adjacent to the exterior of the bag member and within the interior compartment of the storage container, for mitigating and directing explosive forces. The foam material may take the form of substantially rigid blocks. Alternately, the foam material may be constructed from a material which is capable of a selective phase change. Such a foam material would initially have a first phase which solidifies to a second substantially solid phase subsequent to application of the foam material about the bag member. It is contemplated that the foam material may be formed from a fire retarding material, a polymer material, and an elastomeric material. Preferably, reinforcement fibers are disposed within the foam material for enhancing the tensile strength of the foam material.

In addition, the bag member is preferably provided with a foam coating disposed adjacent the interior of the bag member for mitigating explosive forces. The foam coating is preferably formed from a material which is capable of a selective phase change, wherein the bag interior foam coating initially being in a first phase and solidifies to a second substantially solid phase subsequent to application of the bag interior foam coating about the interior of the bag member.

It is contemplated that the storage container may be designed for use in an aircraft having a fuselage. Such a storage container may be constructed of multiple panels which collectively define the interior compartment with a respective one of the panels being formed to be adjacent the fuselage and conform to the shape of the fuselage. Thus, the panel may be sloped or rounded, as may be appropriate. The bag member may be further provided with multiple overlapping folds selectively disposed about the bag member.

In response to an explosion within bag member, it is contemplated that the folds would tend to capture the resulting expanding pressure or shock wave. In doing so the bag member would tend to expand locally at or about the folds. Thus, through the inclusion of the folds, the direction of expansion of the bag member may be preselected. As such, the fold may be selectively positioned adjacent the storage container panel which are along the fuselage of the aircraft, for example, thereby mitigating expansion of the explosive forces perpendicular to the fuselage. Thus, it is contemplated that explosive forces may be directed away from a panel which would be normally positioned adjacent the fuselage of an aircraft. Likewise, the placement of the foam material within the storage container may selectively take into consideration the relative position of the fuselage when the storage container is placed in an aircraft.

The present invention further includes a method of modifying an aircraft storage container for mitigating explosive forces occurring there within. Such a storage container would be similar to those described above. The first step would include forming high strength flexible bag member for distributing force in response to explosive forces emanating from cargo items within the bag member. The bag member includes an interior, an exterior and an opening. The storage container is further provided with a bag opening frame which is attachable to the opening of the bag member and formed to receive cargo items for storage within the bag member therethrough. The bag member includes multiple overlapping door frame folds which are disposed adjacent the bag opening frame for distributing force away from the bag opening frame in response to explosive forces emanating from cargo items within the bag member. The door frame folds are preferably formed by rotating the bag opening frame relative to the hatch such that the door frame folds having a spiral configuration about the bag opening frame.

The bag member is positioned within the interior compartment such that the opening is adjacent the hatch for allowing cargo items to be placed into and removed from within the bag member via the hatch and the opening.

A foam material is next disposed adjacent to the exterior of the bag member and within the interior compartment of the storage container, for mitigating and directing explosive forces. The foam material is described above and is preferably formed from a material which is capable of a selective phase change, wherein the foam material initially is in a first phase and solidifies to a second substantially solid phase subsequent to application of the foam material about the bag member. The foam material is injected into the region between the exterior of the bag.

An inflatable bladder is inserted within the bag member. The bladder is inflated until the bladder substantially contacts the bag member. The foam material is allowed to solidify. Once the foam material solidifies, the bladder is removed. A second layer of foam in the form of a foam coating may be additionally disposed adjacent to the interior of the bag member. It is contemplated that the layers of foam material and the foam coating act to hold the bag member in position. This is especially the case at and around the folds of the bag member.

In addition, the present invention includes an aircraft storage container which is constructed from a plurality of panels joined together to define an enclosed interior compartment. The storage container includes those modifications as described above as well as an access door formed to engage the bag opening frame for closure of the bag member.

Advantageously, it is contemplated that the bag member of the present invention is relatively light in weight, as it is constructed from a flexible high strength material. In comparison, other prior art approaches to mitigating explosive forces incorporate rigid materials such as metal panels and reinforcing members of relatively higher densities. In addition, the bag member is relatively easy to manufacture as no specialized tooling is needed.

In addition, the improvement of the present invention may include a foam material interposed between the bag member and the storage container. The foam material may take the form of rigid blocks which would be inserted through the access hatch of the container and disposed about the container walls. Alternatively, the foam material, comprising of a phase changeable hardenable material, may be injected or blown into place subsequent to positioning the inner bag within the container. Similarly, a foam coating may be injected or blown into place within the interior of the bag member. It is appreciated that manufacturing of such foam material and foam coating is relatively straightforward. Further, it is appreciated that the foam material is relatively light in weight.

Accordingly, based on the foregoing, the present invention represents a significant advance in the art.

BRIEF DESCRIPTION OF THE DRAWINGS

These, as well as other features of the present invention, will become more apparent upon reference to the drawings wherein:

FIG. 4 is a perspective view of the bag member of the present invention;

FIG. 5 is a side view of the bag member as seen along axis 5—5 of FIG. 4;

FIG. 6 is a cross sectional view of a storage container modified in accordance with the present invention;

DETAILED DESCRIPTION OF THE PREFERRED EMBODIMENT

Figure 1:
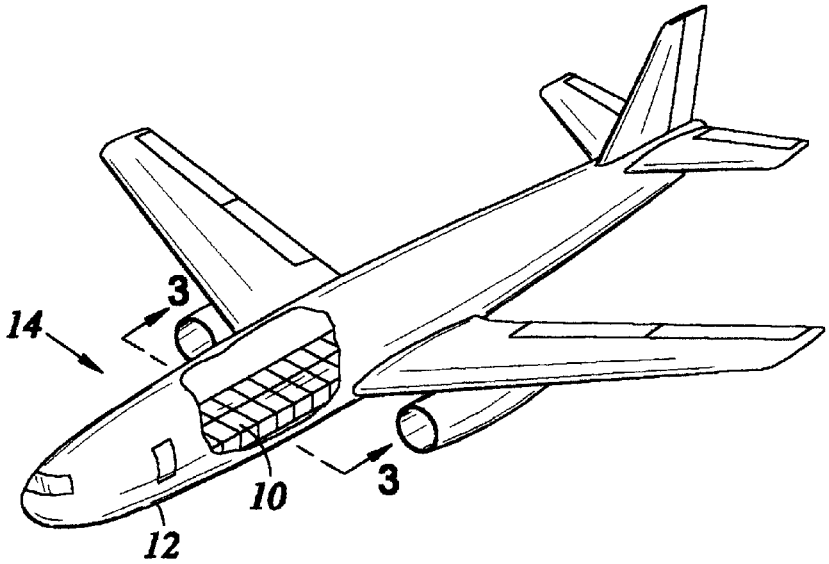
FIG. 1 is a perspective view of an aircraft shown with storage containers of the type used in conjunction with the present invention.
Figure 2:
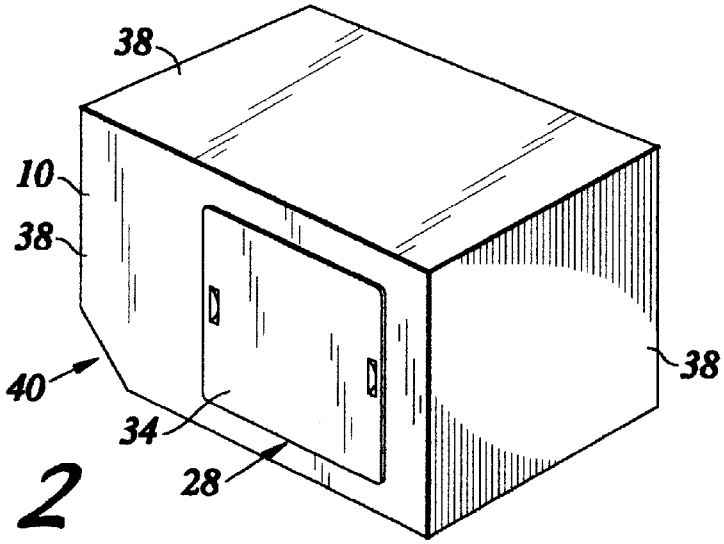
FIG. 2 is a storage container of the type used in conjunction with the present invention.
Figure 3:
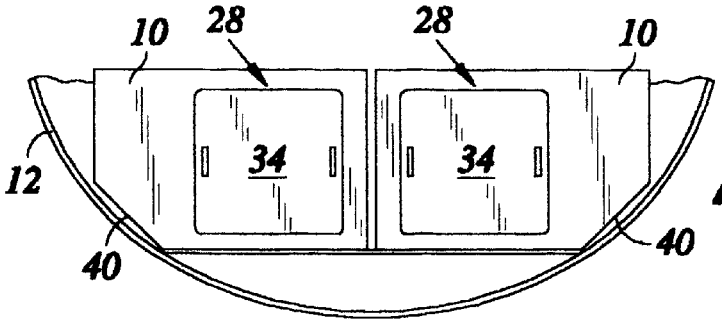
FIG. 3 is an exploded cross sectional view as seen along axis 3—3 of FIG. 1.

Referring now to the drawings wherein the showings are for purposes of illustrating a preferred embodiment of the present invention only, and not for purposes of limiting the same, FIGS. 1–7, 8*a–b,* and 9*a–d* illustrate a modified aircraft storage container 10 in accordance with the present invention. As will be described in more detail below, the present invention discloses the modification of aircraft storage containers to mitigate explosive forces emanating from cargo items placed there within. It is contemplated that aircraft storage containers 10, as so referred to as unit load devices (ULD's), are disposed within the fuselage 12 of an aircraft 14 as depicted in FIG. 1.

In accordance with the present invention, in an aircraft storage container 10 which is used for the transport of cargo items, defines an enclosed interior compartment 16 and includes a hatch 28 for selectively accessing the interior compartment 16, there is provided an improvement of the aircraft storage container 10. The improvement is provided with a high strength flexible bag member 18 disposed about a substantial portion of the interior compartment 16 for distributing and absorbing force in response to explosive forces emanating from cargo items within the bag member 18.

The bag member 18 includes an interior 24, an exterior 22 and an opening 30. The bag member 18 is positionable within the interior compartment 16 such that the opening 30 is adjacent the hatch 28 for allowing cargo items to be placed into and removed from within the bag member 18 via the hatch 28 and the opening 30. The improvement is further provided with a bag opening frame 32 which is attachable to the hatch 28. The bag opening frame 32 interposed therebetween to the opening 30 of the bag member 18 and formed to receive cargo items for storage within the bag member 18 therethrough. It is contemplated that the method of attachment of bag opening frame 32 to the bag opening 30 is chosen from those well known to one of ordinary skill in the art and which may include, for example, adhesive bonding. The bag member 18 includes multiple overlapping door frame folds 36 which are disposed adjacent the bag opening frame 32 for distributing force away from the bag opening frame 32 in response to explosive forces emanating from cargo items within the bag member 18.

The bag member 18 is constructed of a material demonstrating a relatively high tensile strength, such as KEVLAR manufactured by DuPont or SPECTRA manufactured by Allied Signal, for example. The material of the bag member 18 mitigates the explosive forces occurring there within. When explosive forces encounter the interior 24 of the bag member 18, the bag member 18 tends to locally deform to expand in a rounded manner. The high strength bag member 18 strains against the explosive forces and in doing so the bag member 18 acts to dampen, absorb and contain the explosive forces and debris.

Importantly, the bag member 18 includes the multiple overlapping door frame folds 36. Preferably, the door frame folds 36 are formed by rotating the bag opening frame 32 relative to the storage container 10 including the hatch 28 such that the door frame folds 36 having a spiral configuration about the bag opening frame 32, as seen in FIGS. 8*a* and 9*a–d.* in practice, the storage container 10 is provided with a hatch 28 which sealably engages a relatively high strength door 34 which covers the opening into the storage container 10 via the bag opening frame 32 interposed therebetween. In the absence of the improvement of the present invention, in response to an explosion within the storage container 10, the regions around the door 34 and hatch 28 typically experience relatively high stress concentrations. As such, these localized regions are especially susceptible to rupture or failure. The inclusion of the multiple overlapping door frame folds 36 act to distribute force away from these regions thereby mitigating resultant stress concentrations otherwise experienced in the absence of the present invention. With the present invention, however, in response to an explosion within the storage container 10, the bag member 18 tends to outwardly expand in doing so the explosive forces are translated to the bag member 18. It is contemplated that the internal expanded volume or capacity of the inner bag member 18 is on the same order of magnitude as the internal volume or capacity of the storage container 10. In the absence of the folds 36, the forces within the expanding, straining bag member 18 would directly encounter the attachment point between the bag opening frame 32 and the rest of the bag member 18. Such a direct communication may result in a high stress concentration between the rigid bag opening frame and the flexible bag member 18. With the inclusion of the multiple overlapping folds 36 adjacent the bag opening frame 32, however, the folds 36 tend to capture and direct the expanding explosive forces away from the attachment point between the bag opening frame 32 and the bag member 18, and thus away from the attachment point between the bag opening frame 32 and the hatch 28. As such, the explosive forces are directed to the various other portions the bag member 18. Thus, due to the flexible nature of the material forming the bag member 18, the bag member 18 directs and distributes force. In this regard, the bag member 18 mitigates the development of localized stresses occurring at adjacent portions of the storage container 10. In addition, as the bag member 18 expands and becomes locally rounded at various portions thereof, the curvature of the interior 16 of the bag member 18 acts to channel, guide or otherwise direct the expanding explosive pressure wave as the it flows along the curvature of the interior 16 of the bag member 18. Such, localized redirections or channelings of the expanding explosive pressure wave are contemplated to result in a complex interaction which produces a more uniform pressure within the interior 16 of the bag member 18.

The bag member 18 is constructed of a material demonstrating a relatively high tensile strength, such as KEVLAR manufactured by DuPont or SPECTRA manufactured by Allied Signal, for example. It is contemplated that the exact material selected is chosen from those well known to one of ordinary skill in the art, and may include polymers, elastomers, fiberglass, and metals for example. The bag member 18 may be formed into flexible sheet of fabric which may be woven or matted, for example. The bag member 18 may be constructed from a fire resistant or retardant material and may be further coated with a fire resistant or retardant material. The thickness and fabric type of the material forming the bag member 18 is a function of the amount of explosive force desired to be mitigated. In practice it is contemplated that the thickness and fabric type of the material forming the bag member 18 is sized and configured in proportion to the breaking force of the particular type of aircraft storage container or ULD into which the improvement of the present invention is incorporated. For example, the bag member 18 may be formed of a woven sheet of SPECTRA (sample fiber properties: density—0.97 g/cc; filament diameter—38 microns; tensile strength—37500 ksi; tensile modulus—170 ksi) having a thickness of a ¼ inch for use with a standard sized ULD container having general rectangular dimensions of approximately 59 inches by 60.4 inches by 61.5 inches.

The improvement further includes disposing a foam material 26 adjacent to the exterior 22 of the bag member 18 and within the interior compartment 16 of the storage container 10, for mitigating and directing explosive forces. It is contemplated the foam material 26 acts to absorb some of the expanding explosive forces. The foam material 26 may take the form of substantially rigid blocks. Alternately, the foam material 26 may be constructed from a material which is capable of a selective phase change. Such a foam material 26 would initially have a first phase which solidifies to a second substantially solid phase subsequent to application of the foam material 26 about the bag member 18. It is contemplated that the foam material 26 may be formed from a fire retarding material, a polymer material, and an elastomeric material. Preferably, reinforcement fibers are disposed within the foam material 26 for enhancing the tensile strength of the foam material 26.

Figure 7:
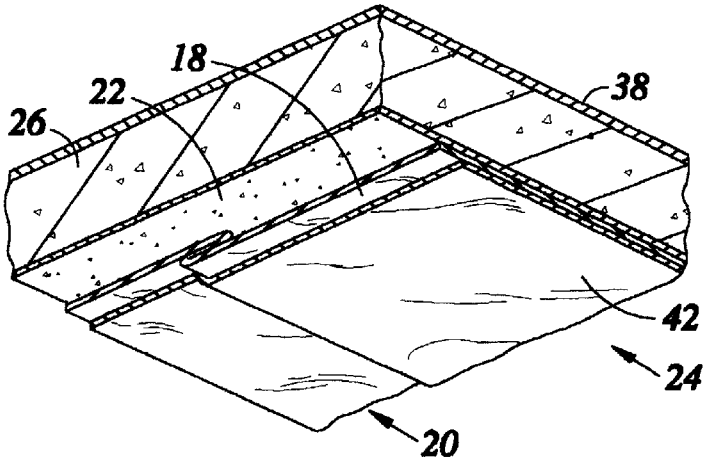
FIG. 7 is an exploded perspective view of the bag member and foam material.
Figure 8A:
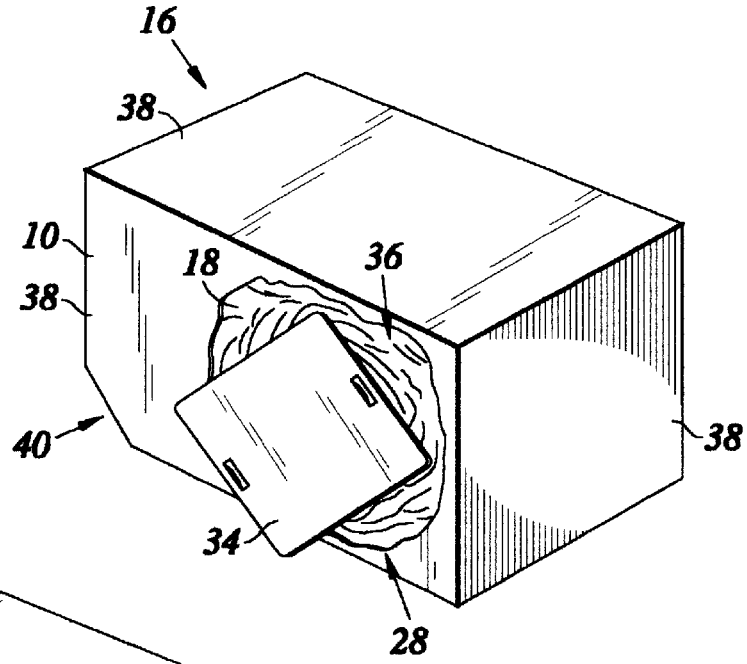
FIG. 8*a* is a perspective view of a modified storage container illustrating partial engagement of the access door.
Figure 8B:
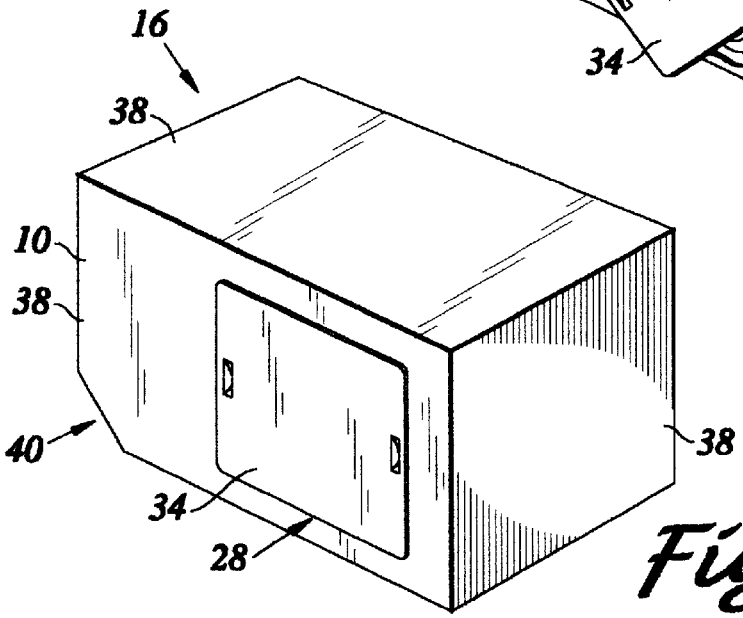
FIG. 8*b* is the modified storage container of FIG. 8*a* with the access door fully engaged.
Figure 9A:
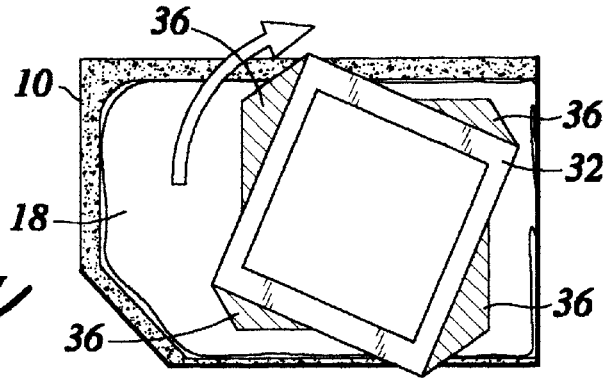
FIGS. 9*a–d* are sequential cross sectional views of a modified storage container with a bag member and bag opening frame sequential rotated.
Figure 9B:
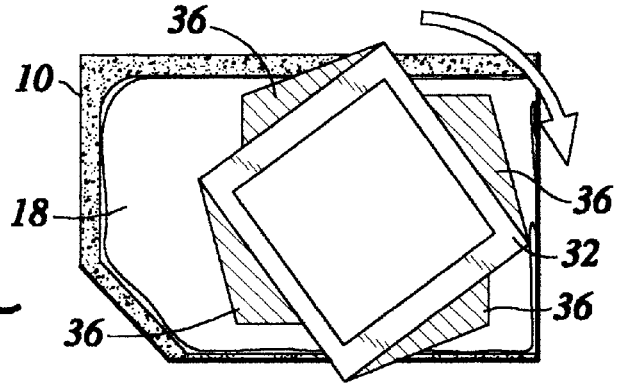
Figure 9C:
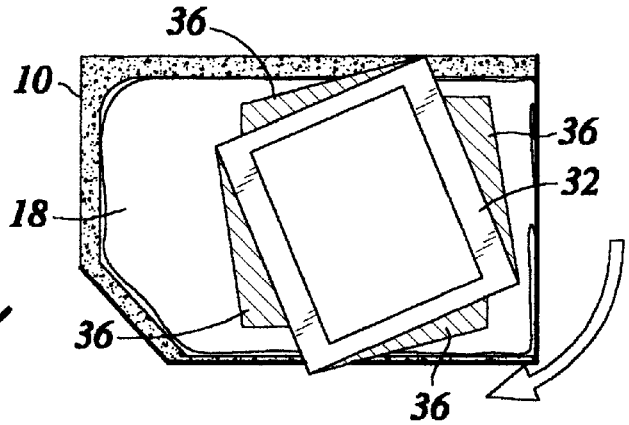
Figure 9D:
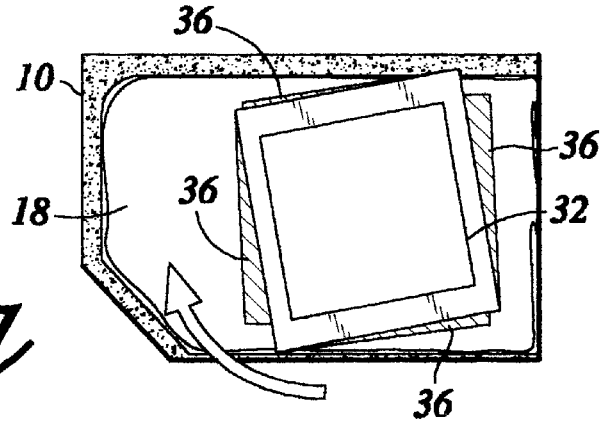

Referring now to FIG. 7, the bag member 18 is preferably provided with a foam coating 42 disposed adjacent the interior 24 of the bag member 18 for mitigating explosive forces. The foam coating 42 is preferably formed from a material which is capable of a selective phase change, wherein the bag interior foam coating 42 initially being in a first phase and solidifies to a second substantially solid phase subsequent to application of the bag interior foam coating 42 about the interior of the bag member 18.

It is contemplated that the storage container 10 may be designed for use in an aircraft 14 having a fuselage 12. Such a storage container 10 may be constructed of multiple panels 38 which collectively define the interior compartment 16 with a respective one 40 of the panels 38 being formed to be adjacent the fuselage 12 and conform to the shape of the fuselage 12. Thus, the panel 40 may be sloped or rounded, as may be appropriate. The bag member 18 may be further provided with multiple overlapping folds 20 selectively disposed about the bag member 18.

In response to an explosion within bag member 18, it is contemplated that the folds 20 would tend to capture the resulting expanding pressure or shock wave. In doing so the bag member 18 would tend to expand locally at or about the folds 20. Thus, through the inclusion of the folds 20, the direction of expansion of the bag member 18 may be preselected. As such, a fold may be selectively positioned adjacent the storage container panel 38 which are along the fuselage 12 of the aircraft 14, for example, thereby mitigating expansion of the explosive forces perpendicular to the fuselage 12. Thus, it is contemplated that explosive forces may be directed away from a panel 40 which would be normally positioned adjacent the fuselage 12 of an aircraft 14. Likewise, the placement of the foam material 26 within the storage container 10 may selectively take into consideration the relative position of the fuselage 12 when the storage container 10 is placed in an aircraft 14.

The present invention further includes a method of modifying an aircraft storage container 10 for mitigating explosive forces occurring there within. Such a storage container 10 would be similar to those described above. The first step would include forming high strength flexible bag member 18 for distributing force in response to explosive forces emanating from cargo items within the bag member 18. The bag member 18 includes an interior 24, an exterior 22 and an opening. The storage container 10 is further provided with a bag opening frame 32 which is attachable to the opening of the bag member 18 and formed to receive cargo items for storage within the bag member 18 therethrough. Referring now to FIG. 8*a* and 9*a–d,* the bag member 18 includes multiple overlapping door frame folds 36 which are disposed adjacent the bag opening frame 32 for distributing force away from the bag opening frame 32 in response to explosive forces emanating from cargo items within the bag member 18. The door frame folds 36 are preferably formed by rotating the bag opening frame 32 relative to the storage containter 10 including the hatch 28 such that the door frame folds 36 having a spiral configuration about the bag opening frame 32. As sequentially depicted in FIGS. 9*a–d,* the bag opening frame is rotated in a clockwise manner to produce the bag opening frame folds 36.

The bag member 18 is positioned within the interior compartment 16 such that the opening 30 is adjacent the hatch 28 for allowing cargo items to be placed into and removed from within the bag member 18 via the hatch 28 and the opening 30.

A foam material 26 is next disposed adjacent to the exterior 22 of the bag member 18 and within the interior compartment 16 of the storage container 10, for mitigating and directing explosive forces. The foam material 26 is described above and is preferably formed from a material which is capable of a selective phase change, wherein the foam material initially is in a first phase and solidifies to a second substantially solid phase subsequent to application of the foam material 26 about the bag member 18. The foam material 26 is injected into the region between the exterior 22 of the bag.

An inflatable bladder, through not shown, is inserted within the bag member 18. The bladder is inflated until the bladder substantially contacts the bag member 18. The foam material 26 is allowed to solidify. Once the foam material 26 solidifies, the bladder is removed. A second layer of foam in the form of a foam coating 42 may be additionally disposed adjacent to the interior 24 of the bag member 18. It is contemplated that the layers of foam material 26 and the foam coating act 42 to hold the bag member 18 in position. This is especially the case at and around the folds 20, 36 of the bag member 18.

In addition, the present invention includes an aircraft storage container 10 which is constructed from a plurality of panels 38, 40 joined together to define an enclosed interior compartment 16. The storage container 10 includes those modifications as described above as well as an access door 34 formed to engage the bag opening frame 32 for closure of the bag member 18.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. An aircraft storage container which is used for the transport of cargo items, the storage container defining an enclosed interior compartment and including a hatch for selectively accessing the interior compartment, the aircraft storage container further comprising:

a high strength flexible bag member disposed about a substantial portion of the interior compartment for distributing force in response to explosive forces emanating from cargo items within the bag member, the bag member including an opening and positionable within the interior compartment such that the opening is adjacent the hatch for allowing cargo items to be placed into and removed from within the bag member via the hatch and the opening;

a bag opening frame attachable to the opening of the bag member and formed to receive cargo items for storage within the bag member therethrough, the bag opening frame being further attachable to the hatch; and wherein the bag member includes multiple overlapping door frame folds disposed adjacent the bag opening frame for distributing force away from the bag opening frame and the attached hatch in response to explosive forces emanating from cargo items within the bag member.

2. The aircraft storage container of claim 1 wherein the door frame folds of the bag member which are disposed adjacent the bag opening frame are formed by rotating the bag opening frame relative to the hatch such that the door frame folds having a spiral configuration about the bag opening frame.

3. The aircraft storage container of claim 1 wherein the bag member has an exterior and a foam material disposed adjacent the exterior of the bag member and within the interior compartment for absorbing explosive forces.

4. The aircraft storage container of claim 3 wherein the foam material is formed into substantially rigid blocks.

5. The aircraft storage container of claim 3 wherein the foam material is formed from a material which is capable of a selective phase change, wherein the foam material initially being in a first phase and solidifies to a second substantially solid phase subsequent to application of the foam material about the bag member.

6. The aircraft storage container of claim 3 wherein the foam material comprises a fire retarding material.

7. The aircraft storage container of claim 3 wherein the foam material comprises a polymer material.

8. The aircraft storage container of claim 3 wherein the foam material comprises an elastomeric material.

9. The aircraft storage container of claim 3 wherein reinforcement fibers are disposed within the foam.

10. The aircraft storage container of claim 1 further comprises an access door formed to engage the bag opening frame for closure of the bag member.

11. The aircraft storage container of claim 1 wherein the bag member being formed from a fire resistant material.

12. The aircraft storage container of claim 1 wherein the flexible bag member comprises a fabric.

13. The aircraft storage container of claim 1 wherein the flexible bag member comprises a polymer material.

14. The aircraft storage container of claim 1 wherein the flexible bag member comprises an elastomeric material.

15. The aircraft storage container of claim 1 wherein the bag member further comprises multiple overlapping folds selectively disposed about the interior compartment for selectively distributing force thereat.

16. An aircraft storage container which is used for the transport of cargo items, the storage container defining an enclosed interior compartment and including a hatch for selectively accessing the interior compartment, the aircraft storage container further comprising:

a high strength flexible bag member disposed about a substantial portion of the interior compartment for distributing force in response to explosive forces emanating from cargo items within the bag member, the bag member including an interior, an exterior and an opening, the bag member positionable within the interior compartment such that the opening is adjacent the hatch for allowing cargo items to be placed into and removed from within the bag member via the hatch and the opening;

a foam material disposed adjacent the exterior of the hag member and within the interior compartment for mitigating explosive forces;

a substantially rigid foam coating disposed adjacent the interior of the bag member for holding the bag member within the interior compartment;

a bag opening frame attachable to the opening of the bag member and formed to receive cargo items for storage within the bag member therethrough, the bag opening frame being further attachable to the hatch; and wherein the bag member includes multiple overlapping door frame folds disposed adjacent the bag opening frame for distributing force away from the bag opening frame and the attached hatch in response to explosive forces emanating from cargo items within the bag member.

17. An aircraft storage container which is used for the transport of cargo items comprising:

a plurality of rigid panels defining an enclosed interior compartment;

a hatch for selectively accessing the interior compartment;

a high strength flexible bag member disposed about a substantial portion of the interior compartment for distributing force in response to explosive forces emanating from cargo items within the bag member, the bag member including an opening and positionable within the interior compartment such that the opening is adjacent the hatch for allowing cargo items to be placed into and removed from within the bag member via the hatch and the opening;

a bag opening frame attachable to the opening of the bag member and formed to receive cargo items for storage within the bag member therethrough, the bag opening frame being further attachable to the hatch; and wherein the bag member includes multiple overlapping door frame folds disposed adjacent the bag opening frame for distributing force away from the bag opening frame and the attached hatch in response to explosive forces emanating from cargo items within the bag member.

* * * * *